US008251647B2

(12) United States Patent
Jarusel et al.

(10) Patent No.: US 8,251,647 B2
(45) Date of Patent: Aug. 28, 2012

(54) GUIDE DEVICE

(75) Inventors: Matthias Jarusel, Albbruck (DE); Peter Neuenschwander, Zurich (CH); Thorsten Bosse, Zurich (CH); Bent Phillipsen, Baden-Ruetihof (CH)

(73) Assignee: ABB Turbo Systems AG, Baden (CH)

( * ) Notice: Subject to any disclaimer, the term of this patent is extended or adjusted under 35 U.S.C. 154(b) by 0 days.

(21) Appl. No.: 12/835,401

(22) Filed: Jul. 13, 2010

(65) Prior Publication Data

US 2010/0278651 A1 Nov. 4, 2010

Related U.S. Application Data

(63) Continuation of application No. PCT/EP2009/050258, filed on Jan. 12, 2009.

(30) Foreign Application Priority Data

Jan. 15, 2008 (EP) ..... 08150265

(51) Int. Cl.
*F01B 23/00* (2006.01)

(52) U.S. Cl. ..... 415/160

(58) Field of Classification Search ..... 415/155, 415/157, 160, 162, 163, 164, 165, 151; 416/204 R; 60/602

See application file for complete search history.

(56) References Cited

U.S. PATENT DOCUMENTS

| | | | | |
|---|---|---|---|---|
| 3,074,689 | A * | 1/1963 | Chapman | 415/135 |
| 3,542,484 | A | 11/1970 | Mason | |
| 3,747,343 | A * | 7/1973 | Rosen | 60/226.1 |
| 3,817,655 | A * | 6/1974 | Huesgen et al. | 415/209.3 |
| 4,003,675 | A * | 1/1977 | Stevens et al. | 415/150 |
| 4,497,171 | A * | 2/1985 | Corrigan et al. | 60/805 |
| 5,342,169 | A | 8/1994 | Müller | |
| 5,868,553 | A * | 2/1999 | Battig et al. | 415/189 |
| 6,824,355 | B2 | 11/2004 | Behrendt et al. | |
| 2003/0049120 | A1 * | 3/2003 | Behrendt et al. | 415/151 |
| 2005/0232763 | A1 * | 10/2005 | Cormier et al. | 415/208.2 |
| 2005/0286999 | A1 * | 12/2005 | Baar | 415/160 |
| 2008/0107520 | A1 * | 5/2008 | Battig et al. | 415/160 |
| 2008/0295516 | A1 | 12/2008 | Teshima et al. | |

FOREIGN PATENT DOCUMENTS

| | | |
|---|---|---|
| DE | 100 13 335 A1 | 9/2001 |
| JP | 06-010687 | 1/1994 |
| JP | 2002-303147 | 10/2002 |

(Continued)

OTHER PUBLICATIONS

International Preliminary Report on Patentability (Form PCT/IB/373) and the Written Opinion of the International Searching Authority (Form PCT/ISA/237) issued in corresponding International Application No. PCT/EP2009/050258 dated Jul. 20, 2010.

(Continued)

*Primary Examiner* — Edward Look
*Assistant Examiner* — Christopher R Legendre
(74) *Attorney, Agent, or Firm* — Buchanan Ingersoll & Rooney PC

(57) ABSTRACT

The fastening for an attachment of a guide device to a gas outlet housing is positioned in a region radially outside guide blades. In this way, a circumferential position of the guide blades may be freely selected within predefined angles. Collisions are avoided between the guide blades and fasteners.

6 Claims, 2 Drawing Sheets

FOREIGN PATENT DOCUMENTS

| | | |
|---|---|---|
| JP | 2003-527521 | 9/2003 |
| WO | WO 2006/046609 A1 | 5/2006 |

OTHER PUBLICATIONS

Notification of Transmittal of Translation of the International Preliminary Report on Patentability (Forms PCT/IB/338 and PCT/IB/373) and the Written Opinion of the Searching Authority ( Form PCT/ISA/237) issued in the corresponding International Application No. PCT/EP2009/050258 dated Aug. 19, 2010.

R.N. Kemp et al., "Theoretical and Experimental Analysis of the Reduction of Rotor Blade Vibration in Turbomachinery Through the use of Modified Stator Vane Spacing", Technical Note 4373, Sep. 1958, 44 pages.

International Search Report (PCT/ISA/210) dated May 7, 2009.

European Search Report (EPA Form 1507N dated Jul. 10, 2008.

* cited by examiner

GUIDE DEVICE

RELATED APPLICATIONS

This application claims priority as a continuation application under 35 U.S.C. §120 to PCT/EP2009/050258, which was filed as an International Application on Jan. 12, 2009 designating the U.S., and which claims priority to European Application 08150265.0 filed in Europe on Jan. 15, 2008. The entire contents of these applications are hereby incorporated by reference in their entireties.

FIELD

The disclosure relates to the field of turbomachines, for example, exhaust-gas turbochargers for supercharged internal combustion engines, and to a fastening of a guide device to a housing of a turbomachine.

BACKGROUND INFORMATION

Exhaust-gas turbochargers can be used to increase the performance of internal combustion engines (for example, reciprocating-piston engines). An exhaust-gas turbocharger includes an exhaust-gas turbine in an exhaust-gas flow of the internal combustion engine and a compressor in the intake section of the internal combustion engine. A turbine wheel of the exhaust-gas turbine can be set in rotation by the exhaust-gas flow of the internal combustion engine and drives a rotor of the compressor via a shaft. The compressor increases the pressure in the intake section of the internal combustion engine, such that a greater quantity of air can pass into the combustion chambers during an intake. Exhaust-gas turbines can also be used as power turbines. In this case, they can drive via the shaft not the compressor of an exhaust-gas turbocharger but rather a generator or, via a clutch, some other mechanical power part.

Recent developments in the field of modern reciprocating-piston engines have been driven by a desire to reduce emissions, costs and fuel consumption. Here, the supercharging system of the engine can make a contribution to achieving these development aims. In the past, in large engines, use was made predominantly of exhaust-gas turbochargers with turbine and compressor components with fixed geometries. The geometries were designed and adapted for each individual engine. They were however invariable during the operating of the engine. To enable a better adaptation of the exhaust-gas turbocharger to the engine during operation in future, consideration is increasingly being given to the use of turbine geometries which can be adjusted (or varied) during operation (variable turbine geometries, VTG). Here, the opening of the guide blades of a guide device of the exhaust-gas turbine can be varied by a rotation of the guide blades. The use of adjustable turbine geometries is known in the field of small engines, as used, for example, in passenger motor vehicles. In large gas engines, variable turbine geometries are used which require precise regulation of the fuel/air ratio.

The flow components of the turbocharger have, for reasons of efficiency, been developed for high specific throughputs (i.e., high mass flow in relation to geometric size). The moving blades of the turbines of such turbomachines can be subjected to extreme vibration excitation. To ensure reliable operating behavior, precise coordination of the guide device (nozzle ring) and guide blade geometry is desirable in the development of the turbine.

In particular, a problem can arise that the guide blades of the guide device constitute a periodic disturbance for the moving blades of the turbine wheel, with a frequency equal to number of guide blades multiplied by rotational speed. If the frequency corresponds with natural frequencies of the moving blades, resonances can occur. The alternating stresses at the resonances can lead to material damage. It is known that the resonance amplitudes increase with decreasing opening of the guide blades. This can lead to a limitation of the admissible openings of the guide blades. In the variable turbine geometry, it is desirable to have a large available adjustment range of the guide blade opening. If the range of the admissible guide blade openings must be restricted as a result of inadmissible resonances, the benefit of the variable turbine geometry can be reduced.

From "Theoretical and Experimental Analysis of the Reduction of Rotor Blade Vibration in Turbomachinery Through the use of Modified Stator Vane Spacing", R. H. Kemp, M. H. Hirschberg, W. C. Morgan. NACA Technical Note 4373, 1958, it is known that a non-uniform distribution of the circumferential position of the guide blades can bring about a considerable reduction in the resonance amplitudes. The non-uniform arrangement of the guide blades can be used in many turbomachines in order to reduce resonance amplitudes.

In exhaust-gas turbochargers for large engines, the variable guide device (VTG) can be constructed as a separate module and fastened to the gas inlet and gas outlet housings of the exhaust-gas turbine, as indicated in FIG. 1. An exhaust-gas turbine having a variable guide device fastened in this way is known from DE 100 13 335. The gas inlet housing and the gas outlet housing can generally be freely rotated in steps of defined angles, for example 15°, in order to be fitted to different engines. This can lead to the use of screws distributed uniformly over the circumference for example, in the case of segments of 15°, this results in 24 screws. If non-uniformly arranged guide blades are used, collisions between the guide blades and the screws are inevitable.

An exhaust-gas turbine having a variable guide device is likewise known from U.S. Pat. No. 3,542,484.

SUMMARY

A turbomachine is disclosed, including a housing; and a guide device of annular design and having rotatable guide blades arranged distributed along a circumference of the guide device and mounted in each case with a radially running shank in a support ring of the guide device. The support ring includes bearing points for holding the guide blade shanks and fasteners for fastening the support ring to the housing. Free ends of the guide blade shanks are arranged radially within a first radius ($r_1$) and the fasteners are arranged radially outside a second radius ($r_2$). The radius ($r_1$) is smaller than the second radius ($r_2$), such that the fasteners for fastening the support ring to the housing are arranged radially outside the free ends of the guide blade shanks and, the circumferential position of the guide blades may be freely selected within predefined angles without collisions occurring between the guide blade shanks and the fasteners.

BRIEF DESCRIPTION OF DRAWINGS

Exemplary embodiments of the disclosure will be explained in detail below on the basis of drawings, in which.

DETAILED DESCRIPTION

An adjustable guide device is disclosed for a turbomachine, such as an exhaust-gas turbine, in which fasteners used for fastening to an adjacent housing can be attached independently of the alignment of the guide device with respect to the housing.

In the disclosure the fastening for the attachment of the guide device can be located into the region radially outside the guide blades, in particular radially outside the guide blade shanks. In this way, the circumferential position of the guide blades can be freely selected within the predefined angles. No collisions occur between the guide blades and the fasteners.

The guide blades can be distributed either uniformly or non-uniformly on the circumference.

For the non-uniform arrangement, the guide blades can be realized by non-uniform distribution of the guide blade mounting in the relief ring, support ring and groove ring.

Figure 1:
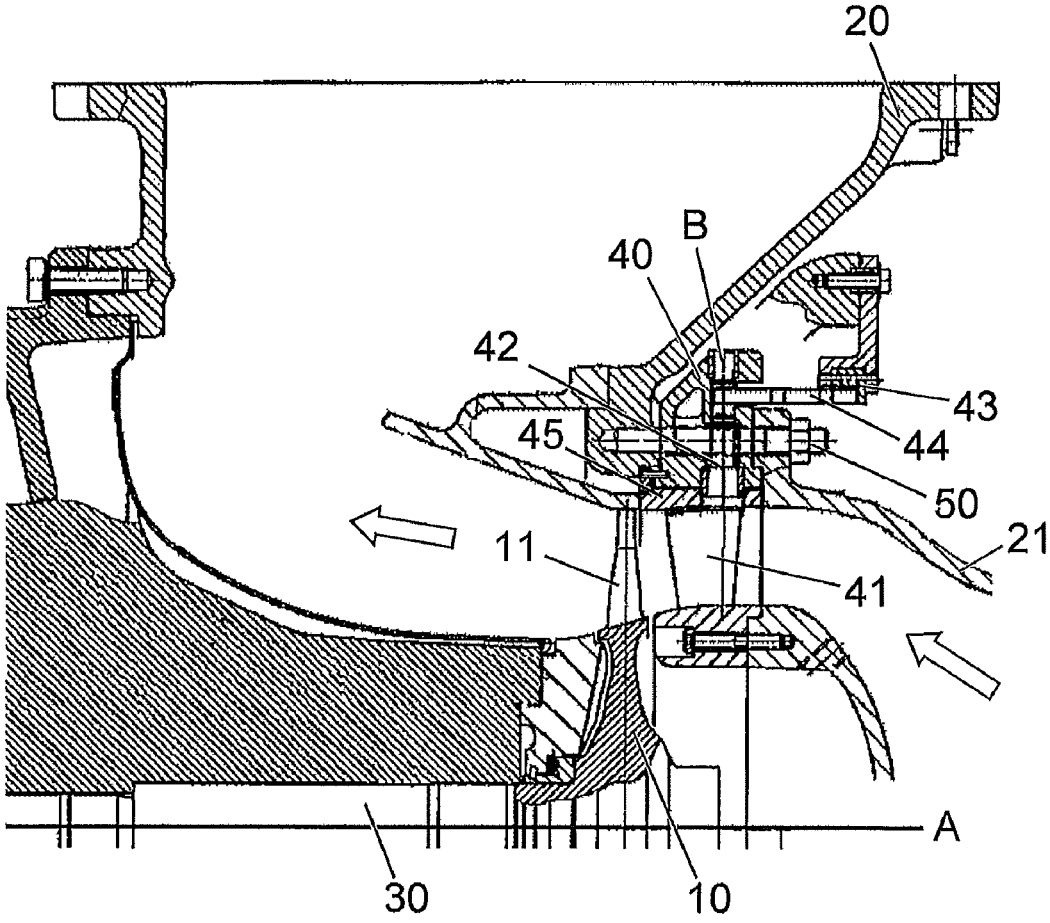
Fig. 1 Prior Art
FIG. 1 shows a section through a known exhaust-gas turbine having an adjustable guide device.

FIG. 1 shows a detail of a known axial turbine of an exhaust-gas turbocharger. The turbine wheel 10 is arranged on the shaft 30 which is mounted in a bearing housing so as to be rotatable about the axis A. The turbine wheel 10 includes a multiplicity of moving blades 11 which are arranged distributed along the circumference on the radially outer edge of the turbine wheel. The exhaust-gas flow in the flow duct is indicated by arrows. Flow approaches the moving blades of the turbine wheel in the axial direction. Arranged upstream of the moving blades 11 of the exhaust-gas turbine is an adjustable guide device 1 (i.e., adjustable turbine geometry). The adjustable guide device 1 includes a multiplicity of guide blades 41 which have in each case one shank 42. Each of the guide blades 41 is mounted in each case with its shank 42 in the housing so as to be rotatable about the axis B. The housing of the guide device 1 includes a support ring 40 which annularly surrounds the flow duct. Toward the flow duct, the support ring 40 may also surround a relief ring 45. The shanks 42 of the guide blades 41 are arranged in the support ring 40 in bores provided for this purpose. The bores, like the shanks 42 of the guide blades 41, run substantially in the radial direction. The support ring is fastened to the gas outlet housing 20 by fasteners 50. Bolts or screws are used as fasteners. The adjustable guide device 1 also includes an adjusting ring 43, and one adjusting lever 44 per guide blade. To adjust the guide device 1, the adjusting ring 43 is moved in the circumferential direction. The adjusting levers 44 transmit the rotational movement to the shanks 42 of the guide blades.

Figure 2:
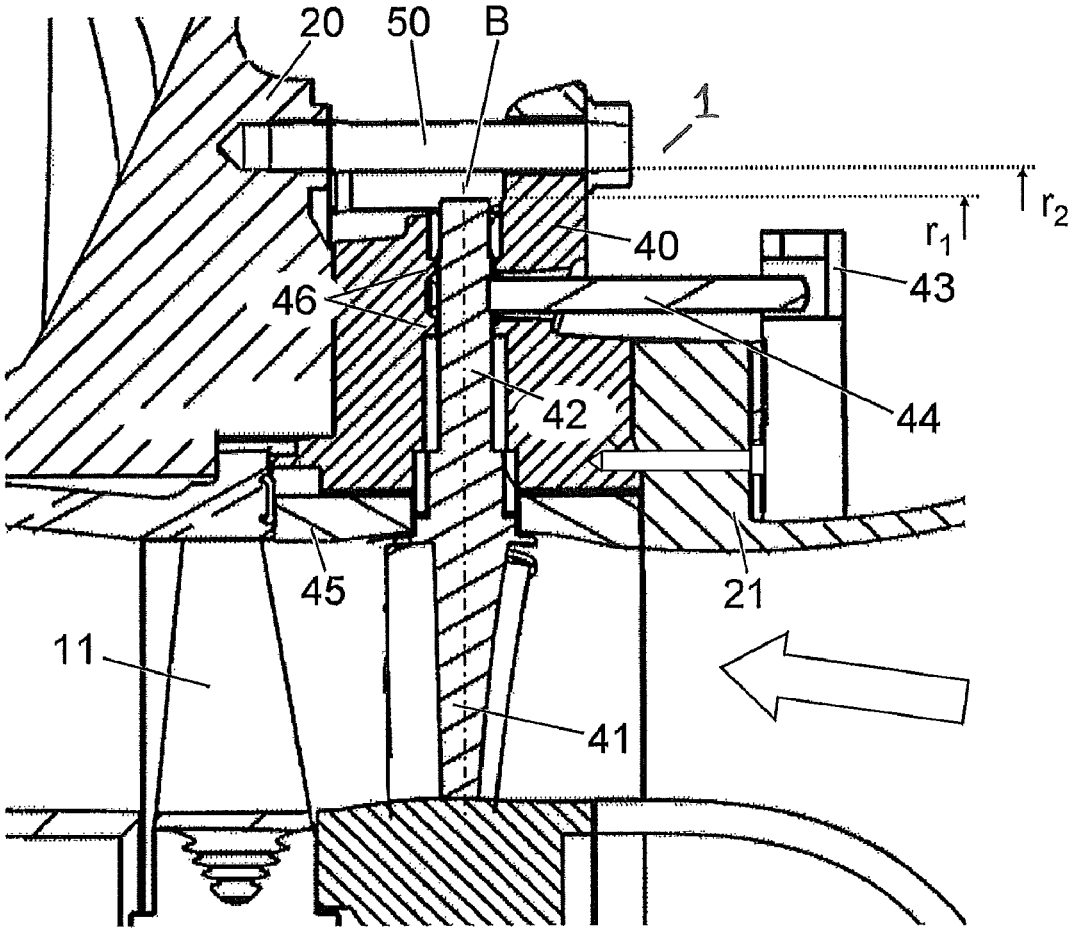
FIG. 2 shows a section through an exhaust-gas turbine having an adjustable guide device designed according to an exemplary embodiment of the disclosure.

In the guide device 1 designed according to the disclosure shown in FIG. 2, the fasteners 50 can be arranged radially outside the bearing points 46 of the guide blade shanks 42, or radially outside the free ends of the guide blade shanks. The radius $r_2$ outside which the fasteners 50 are situated can therefore be greater than the radius $r_1$ within which the guide blade shanks are situated.

The guide blades 41 can therefore be distributed both uniformly and non-uniformly along the circumference of the support ring without the fasteners 50 and the shanks 42 of the guide blades thereby crossing one another. The non-uniform arrangement of the guide blades 41 can be realized by non-uniform distribution of the guide blade mounting in the relief ring 45, support ring 40 and adjusting ring. It is also possible even in the case of non-uniformly distributed guide blades for the support ring 40 to be positioned at any angle in relation to the gas outlet housing 20 permitted by the bores, which can be arranged distributed along the circumference, for the fasteners. The circumferential position of the guide blades may therefore be freely selected within the predefined angles.

As indicated in FIG. 2, the gas inlet housing 21 can be connected, radially within the adjusting lever 44, to the support ring 40 by separate fasteners.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Turbine wheel
11 Moving blades of the turbine wheel
20 Gas outlet housing of the exhaust-gas turbine
30 Shaft of the exhaust-gas turbocharger
40 Support ring, housing of the guide device
41 Guide blades, adjustable
42 Shank of the guide blade
43 Adjusting ring
44 Adjusting lever
45 Relief ring
46 Bearing points for mounting the shank of the guide blade
50 Fasteners for fastening the support ring to the turbine housing
$r_1$ Outer radius of the guide blade shanks
$r_2$ Inner radius of the fastening means for fastening the support ring to the turbine housing
A Axis of the shaft of the exhaust-gas turbocharger
B Axis of the shank of the guide blade

What is claimed is:

1. A turbomachine, comprising:
a housing; and
an annular guide device including:
a support ring having a first through hole and a second through hole, the first through hole arranged radially outside the second through hole
rotatable guide blades arranged along a circumference of the guide device, each rotatable guide blade including a radially running shank for mounting in the support ring, wherein the support ring comprises bearing points for holding the guide blade shanks;
fasteners for fastening the support ring to the housing through the first through hole, wherein free ends of the guide blade shanks are arranged radially within a first radius ($r_1$) and the fasteners are arranged radially outside a second radius ($r_2$), and wherein the radius ($r_1$) is smaller than the second radius ($r_2$), such that the fasteners for fastening the support ring to the housing are arranged radially outside the free ends of the guide blade shanks and, the circumferential position of the guide blades may be freely selected within predefined angles without collisions occurring between the guide blade shanks and the fasteners; and
an adjusting ring including an adjusting lever, the adjusting lever arranged through the second through hole of the support ring.

2. The turbomachine as claimed in claim 1, wherein guide blades are arranged non-uniformly along the circumference of the guide device, with different spacings to one another.

3. The turbomachine as claimed in claim 1, configured as an exhaust-gas turbine of an exhaust-gas turbocharger.

4. The turbomachine as claimed in claim 2, wherein guide blades are arranged non-uniformly along the circumference of the guide device, with the same spacings to one another.

5. An exhaust-gas turbocharger, comprising:

an exhaust-gas flow inlet;

a housing; and an annular guide device including:

a support ring having a first through hole and a second through hole, the first through hole arranged radially outside the second through hole;

rotatable guide blades arranged along a circumference of the guide device each rotatable guide blade including a radially running shank for mounting in the support ring, wherein the support ring comprises bearing points for holding the guide blade shanks;

fasteners for fastening the support ring to the housing through the first through hole, wherein free ends of the guide blade shanks are arranged radially within a first radius ($r_1$) and the fasteners are arranged radially outside a second radius ($r_2$), and wherein the radius ($r_1$) is smaller than the second radius ($r_2$), such that the fasteners for fastening the support ring to the housing are arranged radially outside the free ends of the guide blade shanks and, the circumferential position of the guide blades may be freely selected within predefined angles without collisions occurring between the guide blade shanks and the fasteners; and an adjusting ring including an adjusting lever, the adjusting lever arranged through the second through hole of the support ring.

6. The turbomachine as claimed in claim 1, wherein the first through hole and the second through hole are arranged to have parallel axes.

* * * * *